US005294940A

United States Patent [19]

Wennagel et al.

[11] Patent Number: 5,294,940

[45] Date of Patent: Mar. 15, 1994

[54] PULSED LASER OPTICAL DISPLAY DEVICE

[75] Inventors: Dale A. Wennagel, c/o Philadelphia Electric Company, 2301 Market St., Philadelphia, Pa. 19101; Michael D. Tulloch, Philadelphia, Pa.

[73] Assignee: Dale A. Wennagel, Philadelphia, Pa.

[21] Appl. No.: 651,464

[22] Filed: Feb. 6, 1991

[51] Int. Cl.[5] ..... G09G 3/02

[52] U.S. Cl. ..... 345/31; 345/7

[58] Field of Search ..... 340/752, 755, 705, 716, 340/717; 359/199, 201-204, 216-219

[56] References Cited

U.S. PATENT DOCUMENTS

| | | | |
|---|---|---|---|
| 3,932,861 | 1/1976 | Bull | 340/980 |
| 4,002,830 | 1/1977 | Brown et al. | 359/201 X |
| 4,099,172 | 7/1978 | Montanari | 340/755 |
| 4,190,832 | 2/1980 | Mohler | 340/705 |
| 4,241,343 | 12/1980 | Fan | 340/755 |
| 4,315,240 | 2/1982 | Spooner | 340/980 |
| 4,315,241 | 2/1982 | Spooner | 340/980 |
| 4,340,878 | 7/1982 | Spooner | 340/980 |
| 4,340,888 | 7/1982 | Seroskie | 340/755 |
| 4,347,507 | 8/1982 | Spooner | 340/705 |
| 4,347,508 | 8/1982 | Spooner | 340/705 |
| 4,349,815 | 9/1982 | Spooner | 340/705 |
| 4,427,977 | 1/1984 | Carollo | 340/702 |
| 4,439,755 | 3/1984 | LaRussa | 340/980 |
| 4,560,233 | 12/1985 | Banbury | 340/701 |
| 4,575,722 | 3/1986 | Anderson | 340/783 |
| 4,673,252 | 6/1987 | Kugo et al. | 360/701 X |
| 4,689,604 | 8/1987 | Sokol | 340/755 |
| 4,984,091 | 1/1991 | Murata | 358/244 |
| 5,013,135 | 5/1991 | Yamamura | 340/980 X |

FOREIGN PATENT DOCUMENTS

| | | | |
|---|---|---|---|
| 0047523 | 3/1987 | Japan | 359/216 |

*Primary Examiner*—Jeffery Brier

*Attorney, Agent, or Firm*—Paul and Paul

[57] ABSTRACT

A pulsed laser optical display device includes a source of an image bit map. Activation signals are generated from the image bit map, and used to control the firing of laser diodes arrange in banks and oriented so that the resulting beams impinge upon a rotating polygonal mirror which reflects each beam to impinge on a projection surface, the rotating mirror serving to sweep the beams over the projection surface. Rotation of the mirror is synchronized with activation of the the diodes, so that an image corresponding to the bit map is displayed. Both front-projection and rear-projection surfaces, such as an automobile instrument panel and a heads-up display, can be illuminated simultaneously.

25 Claims, 4 Drawing Sheets

PULSED LASER OPTICAL DISPLAY DEVICE

BACKGROUND OF THE INVENTION

1. Field of the Invention

The present invention relates to visual display apparatus, and particularly to visual projection apparatus for heads-up display of control information and graphics.

2. Background of the Invention

Devices which project visual information onto an opaque surface are well known. Familiar examples include motion picture projectors and projection television. Devices which protect visual information onto opaque, translucent, or transparent surfaces are also known. Examples of the latter include heads-up display systems for aircraft pilot. These devices permit critical information to be brought to the pilot's attention immediately with minimal distraction. Similar devices are also used in flight simulators employed in pilot training.

Examples of the latter are disclosed, for example, in U.S. Pat. Nos. 4,315,240, 4,315,241, 4,340,878, 4,347,507, 4,347,508, and 4,349,815 all assigned to Redifon Simulation Ltd. In the Redifon system such as disclosed, for example, in U.S. Pat. No. 4,315,240, a laser source, apparently a conventional continuous output gas laser, provides a laser beam which is split to provide two beams of equal intensity. Each beam is conditioned by passing through a modulator of conventional design which is controlled by a C.G.I. ("computer generated image") image generator. The output from the modulator is directed onto a polygonal rotating mirror which serves as a line scanner. A fiber optic light guide formed into a flat ribbon carries the scanned line from the line scanner to a frame scanning device which is mounted on the trainee's helmet. The line formed at the output end of the light guide is focused by a spherical lens onto the face of a rotating frame scanning mirror. When the mirror is stationary, emergent rays from the light guide are focused to form a single line of the computer generated image. As the mirror is rotated, successive lines of the image are projected to form an entire scanned image on a projection screen. The protected image simulates a view from the cockpit of an aircraft.

The projected image need not be visually continuous. Devices which project discrete elements of visual information such as alphanumeric characters are also known. For example, U.S. Pat. Nos. 4,241,343 and 4,099,172 disclose display devices which include a bank of light emitting diodes (LEDs) arranged in a row oriented in a common direction. A rotating optical element is provided to condition the light emitted by the LEDs to form a virtual image which is viewed by the observer. The rotating optical element which conditions the beams emerging from the LEDs can be a prism. The output of the LEDs is synchronized with the rotation of the optical element, and the LEDs are pulsed to form the image. The '172 patent also discloses an embodiment in which a plurality of plasma tubes are rotated to form a virtual image.

U.S. Pat. No. 4,109,832 discloses a device for projecting the image of a liquid crystal display onto an automobile windshield. This system employs reflected light during daylight hours and a weak, shadow-casting light source at night to provide the displayed image.

U.S. Pat. No. 4,439,755 provides a heads-up infinity display and pilot sight for projecting a reticle of weapon impact points, enhanced or computer processed data base images of the terrain over which the vehicle is passing and/or the like, without preventing the pilot from continuing to look out the windscreen of the aircraft.

U.S. Pat. No. 4,560,233 discloses an improved heads-up display, employing a cathode ray tube (CRT) having a penetron type of phosphor for providing a color display.

U.S. Pat. No. 4,427,977 discloses a video image display apparatus in which the scene displayed is determined by sensing the orientation of the viewing mechanism as controlled by user.

U.S. Pat. No. 4,575,722 discloses a heads-up magneto-optic display.

Despite the substantial advances which have been made in providing heads-up type displays for vehicle operators such as aircraft pilots and operators of vehicle simulators, there remains a substantial need for a simple visual display device which can be used to project real time information to vehicle operators such as automobile drivers. Similarly, there remains a substantial need for a simple, visual information display device which can be used to provide large scale displays of real time information which can be viewed simultaneously by a number of observers, such as plant operators situated in a control room of an electric utility generating plant, a manufacturing or chemical processing facility, or the like.

SUMMARY OF THE INVENTION

The present invention provides a pulsed laser optical display device. The device includes a source of an image bit map and means for generating a plurality of activation signals from the image bit map, as well as at least one light source bank, including a plurality of laser diodes or other high output light emitting diodes, pointed in the common direction, each diode being adapted to produce a light beam. Associated with each laser diode is a diode driver which activates its respective laser diode in response to an activation signal. The device further includes at least one projection surface and polygonal mirror reflection means for reflecting each laser beam to impinge on a projection surface. Drive means are employed for rotating the reflection means to sweep the light beams over the protection surface. Further, the device includes synchronization means for synchronizing the activation signal to each diode driver means with rotation of the reflection means, whereby an image is displayed on at least one projection surface.

In one presently preferred embodiment the display device has a reflection means which includes the plurality of planar mirror surfaces, and the synchronization means includes a first means for sensing each angular position of the reflection means at which a light beam from a laser diode can begin to impinge on a respective planar mirror surface as the reflection means rotates, the first angular position sensing means generating a first synchronization signal in response thereto. In this embodiment, the synchronization means further includes a second means for sensing a plurality of intermediate angular positions of the reflection means, as the reflection means rotates through an arc, during which the light beams from a laser diode bank can impinge on a single reflection surface, the second angular position sensing means generating a plurality of second synchronization signal pulses in response thereto. Means are provided for detecting a second synchronization signal pulse and producing the activation signal to trigger predetermined laser diode drivers in response thereto. Resettable row counter means count the second synchronization signal pulses, the count representing a row address.

In this embodiment, the image bit map is stored in a display memory means, the display memory means being organized as n columns by m rows. The activation signal generating means includes means for selecting a predetermined row of the display memory means in response to the row counter means output. The display memory means include parallel output means for outputting the contents of the predetermined row to the selected laser diode drivers. The display memory means can contain an initial n column by m row image bit map. However, the bit map in the display memory means can be updated by replacing each row of the initial bit map with the respective row of a new image bit map as each row of the initial bit map is outputted to select laser diode drivers. The new image bit map can be obtained from an image generating computer and/or circuitry that drives an interleaving CPU.

This laser optical display device can include means for conditioning the second synchronization signal pulses to adjust the output of the laser diode drivers to conform to the displayed image to the geometry of the display surface.

In another presently preferred embodiment of the invention, the display device includes at least one first bank of laser diodes and at least one second bank of laser diodes, as well as at least first and second projection surfaces. In this case, the light beams generated by the first bank are directed by the reflection means to the first projection surface and the light beam is generated by the second bank of laser diodes are directed by the reflection means to the second projection surface. In this embodiment, at least predetermined portions of the first projection surface are translucent and the first projection surface is one surface of a projection screen. The first light beam impinges on the first projection surface to form a first image, the first image being viewed through the first projection surface. In addition, the second light beams impinge on a second projection surface to form a second image, the second image being directly viewable by an observer. This embodiment can include display selection means for directing at least a portion of the image bit map to generate an image on either of the first or second projection surfaces or both. A sensing means can also be included for sensing the occurrence of a predetermined condition. In this case display selection means can be adapted to respond to the sensing means to alter the image displayed in response to the sensing means. For example, the second projection screen can be illuminated in response to the occurrence of predetermined conditions by the sensing means.

Other objects and advantages of the present invention will become readily apparent to those skilled in the art from a reading of the following brief description of the drawings, the detailed description of the preferred embodiments, and the appended claims.

DETAILED DESCRIPTION OF THE PREFERRED EMBODIMENT

Figure 1:
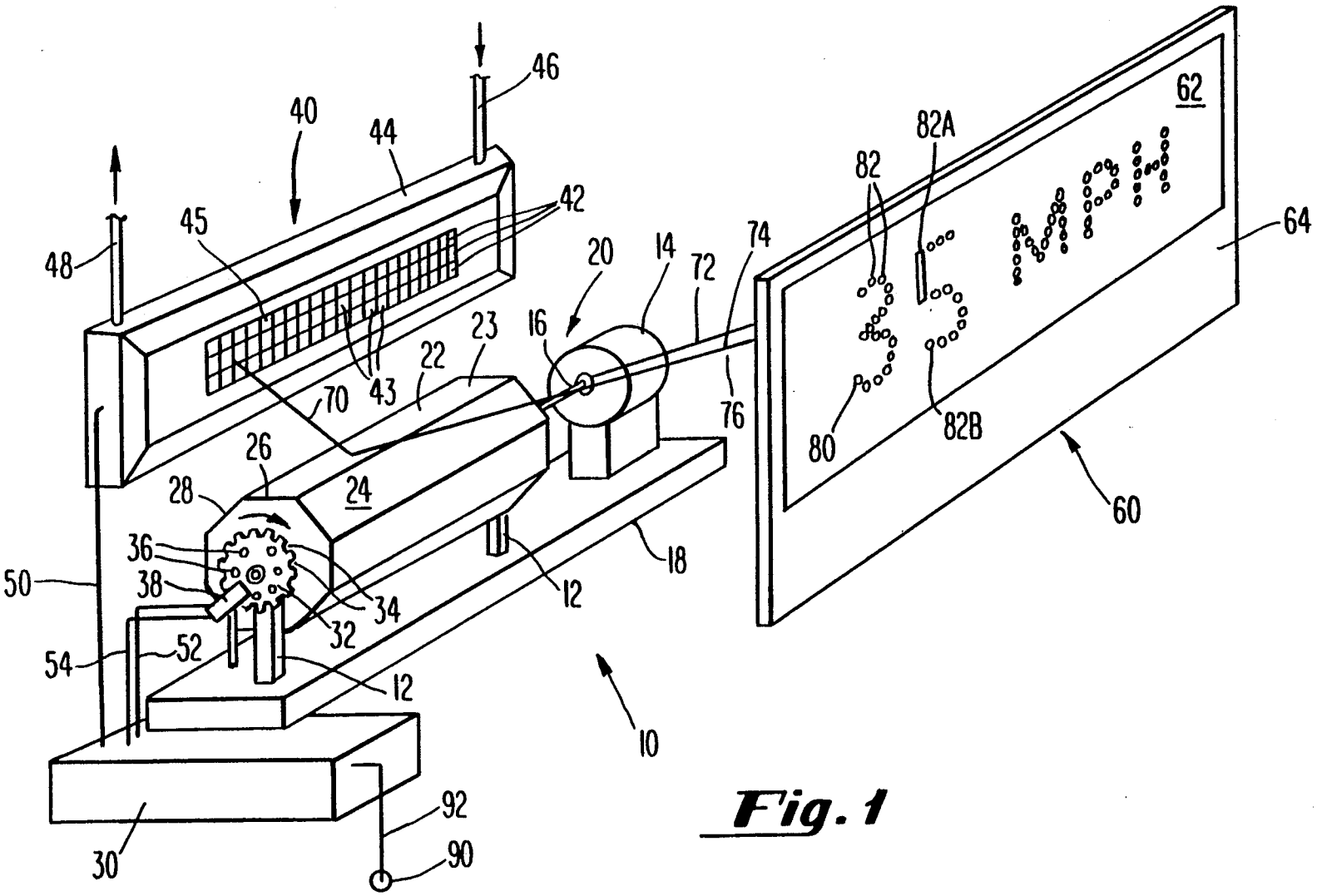
FIG. 1 is a perspective view of a pulsed laser optical device according to the present invention.

Referring now to the drawings in detail, wherein like reference numerals indicate like elements in each of the several views, reference is first made to FIG. 1, wherein a pulsed laser optical display device 10 according to the present invention is illustrated. The display device 10 includes a light source assembly 40, a light deflector assembly 20, and a display assembly 60. The light source assembly 40 includes a plurality of parallel elongated light source banks 42. Each light source bank 42 includes a plurality of laser diodes 43, each of the laser diodes 43 is powered by a respective driver (not shown). When enabled, each respective diode driver supplies current to a respective diode 43, and the diode in turn is illuminated producing an intense beam of coherent light 70. The diodes 42 are oriented so that the light beams 70 emitted by the diodes 42 are generally parallel; that is, the laser diodes 43 are pointed in a common direction. Each diode driver is enabled or activated in response to an activation signal supplied to the light source assembly 40 through a control cable 50. The control cable 50 extends from a control unit 30. If desired, elongated "ribbons" (not shown) including a plurality of like diodes in a single package aligned on a common axis and oriented at a common angle to that axis can be used, with each ribbon providing the equivalent of one or more light source banks 42. Preferably, the output of each diode corresponds to a single pixel is one line of the viewed image in a monochrome image, and each pixel of a color image being formed by the output of at least two lasers having different output frequencies.

The laser diodes can be pulsed type laser diodes such as GaAs single heterojunction and GaAsIn multiple heterojunction high power type infrared laser diodes, or other infrared type lasers can be employed, provided a frequency doubling crystal, such as KTP, is used to shift the laser output into the visible range. Alternatively, visible-light emitting laser diodes, such as the AlGaAs single heterojunction and InGaAs/InGaP double heterojunction red-emitting laser diodes described by H. Kressel et al in *Appl. Phys. Lett.* 28 598 (1976) and 30 749 (1977) (0.64 micron, pulsed mode operation), can be used. Similarly, laser diodes or other high output sources can be used to end-pump or side-pump laser rods (such as ruby) which lase at visible wavelengths. Further, infrared laser diodes can be used to pump infrared-emitting, paramagnetic ion-doped laser rods, such as neodynium-YAG, provided a nonlinear crystal such as KTP is employed to select a visible harmonic mode, as disclosed by F. Hanson, et al., *Applied Optics* 27 80 (1988). Tunable solid state lasers, such as reviewed in J. C. Walling, "Tunable Parametric-Ion Solid State Lasers," *Tunable Lasers* (Springer-Verlag Berlin 1987)

391-393, can be used with harmonic-generating nonlinear crystals to produce tunable visible laser light, such as disclosed by J. C. Walling et al., *IEEE J. QE*-21 1568 (1985) (tunable alexandrite laser, generating 260 mJ pulses at 380 nm). These lasers can be tuned to produce red, green, and blue light which can be used in embodiments of the present invention providing color image projection systems. Alternatively, high output light emitting diodes having non-coherent outputs can be used, including blue-light emitting SiC diodes, as well as red-light, green-light, and/or yellow-light emitting diodes.

The light deflector assembly 20 includes a base 18 on which is mounted a motor 14 and a polygonal mirror reflection means 22. The rotational speed of the motor 14, which is preferably of the nonsynchronized type, can be controlled and/or monitored by the control unit 30. The motor 14 drives the polygonal mirror reflection means 22 through a shaft 16 there between. The rotational axis of the polygonal mirror reflection means 22 is generally parallel to the laser diode rows 42. The polygonal mirror reflection means 22 includes a plurality of planar, generally rectangular faces 24, 26, 28, which serve to reflect incident light beam 70 emitted by the laser diode 43. The duration of a pulse by a laser diode 43 is typically short in comparison with the rate of rotation of a polygonal mirror reflection means 22 so that as the reflection means 22 rotates, the incident light beam 70 is reflected by a face 23 to give a reflected beam 72 which is swept through a relatively small angle. The reflection means 22 is rotatably mounted on a pair of supports 12, extending from the base 18 of the light deflector assembly 20. The shaft 16 extends through the reflection means 22 and is rigidly affixed thereto for rotation therewith.

At one end of the shaft 16, a notched disk 32 is also rigidly affixed for rotation therewith. The notched disk 32 includes a plurality of notches 34, formed in its periphery. In addition, the notched disk 32 includes a plurality of holes 36, formed at equal radial distances. Extending on either side of the notched disk 34 is a sensor holder 38, which is mounted on the base 18. The sensor holder 38 includes a first sensor light source **37*a* and first position sensor 37*b* (not shown) for monitoring the relative angular displacement of the notched disk 32, as well as a second sensor light source 39*a* and second position sensor 39*b* (not shown), for monitoring predetermined angular displacements of the notched disk 32**.

The first sensor light source **37*a* is mounted in the sensor holder adjacent a first side of the notched disk 32 and is positioned so that as the notched disk 32 rotates the holes 36 formed in the notched disk 32 become momentarily aligned with the first sensor light source 37*a*. The first position sensor 37*b* is mounted in the sensor holder 38 adjacent a second side of the notched disk 32 and positioned proximate the first sensor light source 37*a* so that the first sensor light source 37*a*, a hole 36 formed in the notched disk 32, and the first position sensor 37*b* are momentarily aligned on a single axis as the notched disk 32** rotates.

As the first sensor light source **37*a* is constantly illuminated, the output from the first position sensor 37*b* is a series of pulses which coincide with rotation of the slotted disk 32 and the reflection means 22 through a series of predetermined angular positions. The output of the first position sensor 37*b* is amplified and conditioned by first signal conditioning means 56 (not shown), positioned within the sensor holder 38 and delivered through a sensor cable 54 to the control unit 30. The first position sensor 37*b* and the first amplification and conditioning means 56 are selected to provide rapid and accurate indication of the angular position of the reflection means 22**.

A second sensor light source **39*a* and second position sensor 39*b* are also mounted in the sensor holder 38 on opposite sides of the notched disk 32 proximate the periphery of the notched disk 32. The second sensor light source 39*a* and second positioned sensor 39*b* are positioned so that the second sensor light source 39*a*, a notch 34, and the second positioned sensor 39*b* are momentarily aligned on a single axis as the notched disk 32 rotates. Thus the output of the second position sensor 39*b* is a series of pulses indicating predetermined angular positions of the notched disk 32 and reflection means 22. Pulses are amplified and conditioned by the second amplification and conditioning means 58 and provided to the control unit 30 through the sensor cable 54. A light source cable 52 extending between the control unit 30 and the sensor holder 38 provides power for the first and second sensor light sources 37*a*, 39*a***.

The light beams 70 incident on a face 23 of the reflection means 22 is directed by the reflection means 22 to impinge on a projection screen 62 mounted in the display assembly 60. The projection screen 62 is mounted in a screen holder 64. As described below, the activation signals provided to each diode driver is synchronized with the rotation of the reflection means 22 by means of the first and second positioned sensors **37*b*, 39*b*, and the control unit 30. In this embodiment a sensor 90 monitoring an external condition such as vehicle speed provides a signal to the control unit 30 through a sensor cable 92. This information is employed in the control unit 30 to modulate the activation signals provided through the control cable 50 to the diode drivers to provide a plurality of pulsed light beams 70 from the laser diodes 43. The light beams 70 are reflected by the reflection means 22 to provide a plurality of image elements 82 on the projection screen 62, the image elements 82 being perceived by an observer as a single, instantaneous image 80**.

Depending on the duty cycle of the laser diodes image elements 82 may be more or less relatively elongated in a direction perpendicular to the rotational axis of the reflection means 22. For example, when a pulse 70 is initiated it can be reflected by a surface 22 as a first reflected beam 72 at first predetermined angular position of the reflection means 22. As reflection means 22 rotates, the reflected beam is swept through an arc until finally the pulse from the laser diode is terminated, the reflected beam forming at that time a second reflected beam 74. The reflected beam incident on the projection screen 62 thereby forms an image element **82*a*. Later, the same diode 42 can be briefly pulsed to provide an incident beam 76 which is reflected by another face 23 of the reflection means 22 to provide a second image element 82*b*. The same sequence of pulses can be repeated as each successive face 23 of the reflection means 22 passes through an angular position in which the face 22 can reflect an incident beam 70. For example, the sequence can be initiated as a first planar mirror surface 24 passes through the predetermined range of angular positions and repeated as a second planar mirror surface 26, a third planar mirror surface 28** and succeeding planar mirror surfaces are displayed through the beam.

The holes 36 are positioned in the notched disk 32 so that the output signal from the first position sensor corresponds to the angular position at which a face 23 of reflection means 22 can initially reflect an incident beam 70 to form an image element 82 on the projection screen 62. Similarly, each notch 34 formed in the notched disk 32 corresponds to a predetermined angular position of the reflection means 22, a plurality of contiguous notches corresponding to a sequence of predetermined angular positions of the reflection means 22 and a sequence of loci on the projection screen 62 spanning the projection screen from top to bottom for each face 23 of the reflection means 22.

The light source assembly 40 includes three rows 42 of laser diodes 43 each row 42 being comprised of laser diodes 43 having differing spectral characteristics. Further, the rows 42 of laser diodes 43 are positioned and oriented such that when all three laser diodes 43 in a given diode column 45 are simultaneously activated a single white image element 82 is formed on the projection screen 62. The spectral characteristics of the diodes 43 and the relative amplitudes of the beam 70 produced by the diodes 43 are selected to provide the generally white image element 82 by color addition. Different colors can be provided by selecting different combinations of the three diodes 43 in a row 45 and the relative amplitudes of the beam 70 produced thereby.

Figure 2:
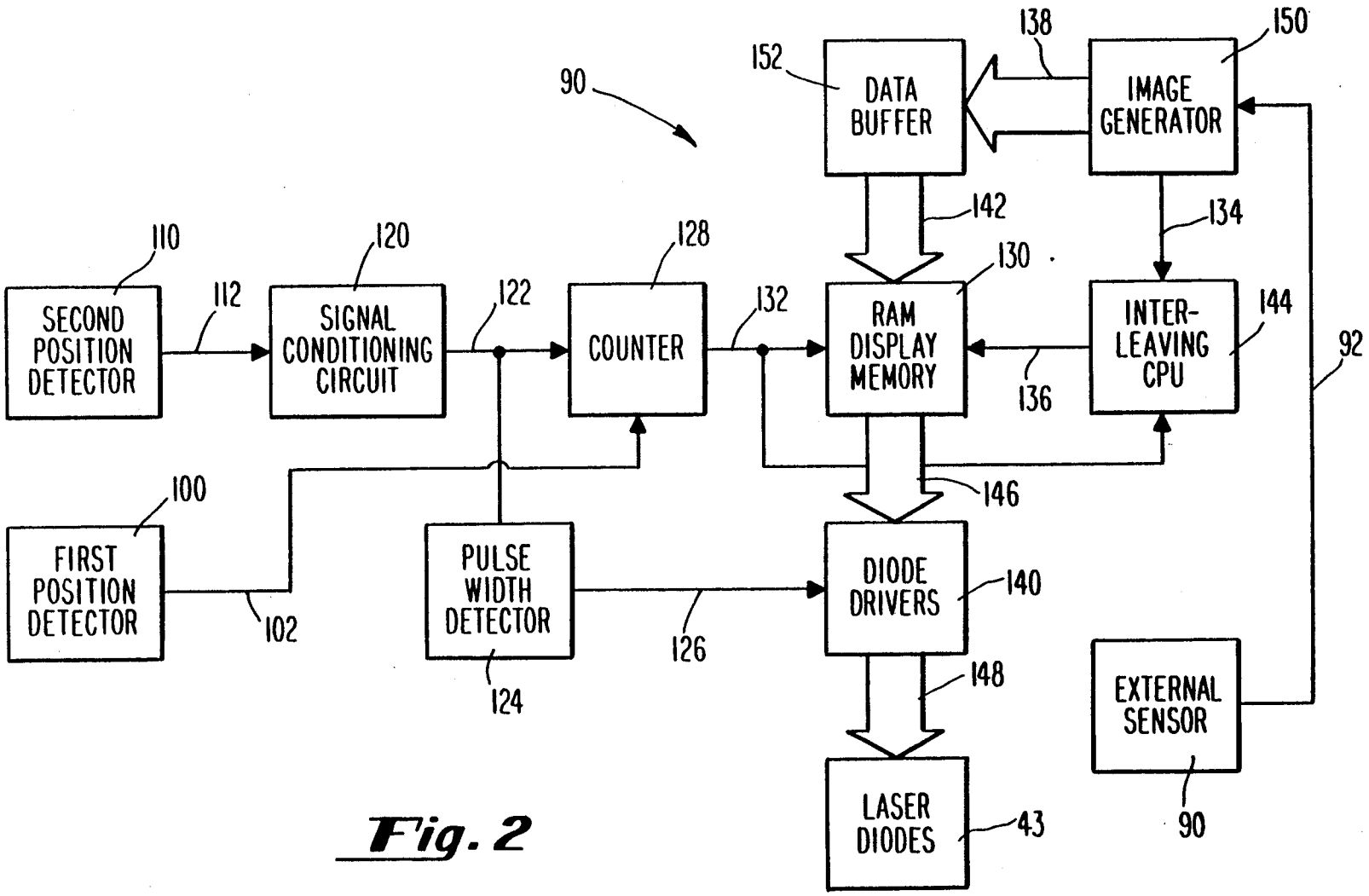
FIG. 2 is a block diagram of the control circuit of the pulsed laser optical display device of FIG. 1.

FIG. 2 is a block diagram of the means employed for controlling the operation of the optical display device 10 illustrated in FIG. 1. The control circuit 90 includes a first position detector 100 which includes the first position sensor 37*a* (FIG. 1) and an associated amplification and conditioning circuit. When the notched disk 32 rotates so as to permit the first sensor light source 37*a* to illuminate the first position sensor 37*b* through a hole 36 formed in the notched disk 32, the first position detector 100 (FIG. 1) outputs a first synchronization signal on line 102 to reset a counter 128. As noted above, the angular position of the hole 36 formed in the notched disk 32 relative to the respective faces 23 of the polygonal mirror reflection means is such that the first synchronization signal is generated in response to the first position sensor 37*a* sensing the angular position of the mirror reflection means at which a light beam from the laser diode bank 42 can begin to impinge on respective planar mirror surface as the reflection means 22 rotates. The first synchronization signal in effect signals the beginning of a new image frame to be displayed on the projection screen 62.

The second position detector 110 includes the second position sensor 39*a* and associated amplification and conditioning circuitry. As noted above, whenever the angular position of a notch 34 formed in the notched disk 32 permits, light from the second light source 39*a* to be sensed by the second position sensor 39*b*. As each notch 34 becomes momentarily aligned with the second sensor light source 39*a* and second position sensor 39*b*, the second position detector 110 outputs a second synchronization signal pulse on line 112 which is received by a signal conditioning circuit 120. The signal conditioning circuit 120 alters the pulse shape and timing as described below. The signal conditioning circuit 120 responds to the second synchronization signal pulse received on line 112 by outputting a synchronization signal pulse on line 122 which transmits the synchronization pulse to counter 128 and to a pulse width detector 124.

The counter 128 is incremented each time it receives a synchronization pulse on line 122 from the signal conditioning circuit 120.

Each second synchronization pulse corresponds to an image line formed on the projection screen 62.

The image to be displayed on the screen 62 is initially formed as an n column by m row image. The number of columns n is equal to, greater than or less than the number of diodes in each laser diode bank 42. The number of rows in the image is governed by a number of factors including the physical dimension of the direction screen 62, and the duty cycle of the laser diodes.

At times it may be desired to display an image or series of images which have been created for display by a conventional raster technique, such on a cathode ray tube (CRT) or similar device. In such a case the image typically comprises a bit map having at least one bit per pixel of the raster display, such as used in the Apple Macintosh display. In a color display, multiple bits must be allocated to each pixel to signify hue, such as in a VGA display where 6 bits are allocated to denote color.

The dimensions of the bit map can be fixed by convention For example, if the raster device is a television adapted to display an NTSC signal, the bit map will have dimensions of 230 columns by 512 rows (raster scan lines). Similarly, if the raster device for which the image has been developed is a television adapted to display a PAL signal, the image bit map will have dimensions of 300 columns by 625 rows. Other image formats can also be supported by the display device, such as CGA, EGA and VGA.

Preferably, the number of diode "columns" is equal to or greater than the largest number of columns in any "raster image" which is likely to be displayed using the device of the present invention. In one embodiment of the present invention, the bit map of the "raster image" is mapped onto the image space of the display device using conventional transformation techniques so that the entire image space is filled. In another embodiment, only a subset of the image space of the display device is filled by the mapping of the raster image. In this later case the mapping can be one-to-many, and the displayed image will be "clipped" and will fill less than the entire field of the display device where the image space of the display device has a greater number of rows and/or columns that the raster scan image. If desired, multiple images can be superposed for display by conventional techniques, as in display devices such as CRTs.

The image generator or graphics processor 150 can include conventional graphics hardware and software and can include means for providing new images at high frequency, such as VLSI graphic chips. The output of the image generator 150 can be dependent on input from an external sensor 90 transmitted through a line 92, as, for example, when the display device is used to provide a real time display of a quantity such as vehicle speed. In this instance, the external sensor can provide, for example, a voltage proportional to vehicle speed. The image generator 150 can include conventional means for converting an analog signal to a digital signal, such as an A-to-D converter, as well as conventional signal conditioning devices such as sample-and-hold amplifiers and the like. Thus, the voltage output of an external sensor 90 responding to vehicle speed can be manipulated and conditioned in the image generator 150 to provide a graphic image corresponding to that vehicle speed in real time.

The image is output row-wise by the image generator 150 to a data or frame buffer 152 over a bus 138 while synchronization information is transmited to an interleaving CPU 144 over a line 134. The contents of the data buffer 152 are subsequently downloaded via a bus 142 to a RAM display memory 130. The RAM display memory 130 is a "video RAM" having both an input port and an output port. The output of the counter 128 on line 132 is the row address of the image to be displayed. The row address is also provided to the interleaving CPU 144. The row address is used to select the specific row of the image contained in the RAM display memory 130 which is to be output over bus 146 to the diode drivers 140. When the output of the pulse width detector 124 is received over line 126 the selected diode drivers 140 energize corresponding laser diodes 43 over lines 148 which in turn momentarily illuminate portions of the projection screen 62 depending on the angular position of the reflection means 28.

The display device 10 can be constructed so that the image is transferred synchronously from the image generator 150 to the RAM display memory 130. In this case, an image is down loaded from the image generator 150 at a frequency equal to the frequency at which the projection screen 62 is scanned by the polygonal mirror reflection means 28. Alternatively, the image can be downloaded from the image generator 150 asynchronously. For example, it may be desirable to download the image from the image generator 150 only when the image has changed, as when the input received from the external sensor 90 varies.

The interleaving CPU or display controller 144 is used to insure that "collisions" do not occur in the RAM display memory 130. Transfer of the image from the data buffer 152 over bus 142 to the RAM display memory 130 occurs under the control of the interleaving CPU 144. The interleaving CPU 144 is programmed to avoid attempting to transfer data from the data buffer 152 to a specific row of the RAM display memory 130 when the address of that specific row has been selected by the counter 128.

The signal conditioning circuit 120 can be used to control the spacing of the rows of the image 80 displayed on the projection screen 62. Assuming planer polygonal mirrors are employed, and assuming that the notches 34 are equally angularly spaced, the rows of the image 80 would tend to be closely spaced in the center of the image and more distantly spaced at the upper and lower portions of the image. The signal conditioning circuit 120 can be used, for example, to delay the output of the second position sensor 110 depending on the specific row to be illuminated. For example, the output of the counter 128 can be used by the signal conditioning circuit 120 to selectively delay the output of the second position sensor 110 to provide a more regular row spacing. Similarly, the geometry of the projection screen can be compensated for using the signal conditioning circuit 120. For example, when an image is to be displayed on a projection screen having curvature, the spacing of the rows displayed on the projection screen can be altered by the signal conditioning circuit 120 to provide a more legible image than would otherwise be possible.

Figure 4:
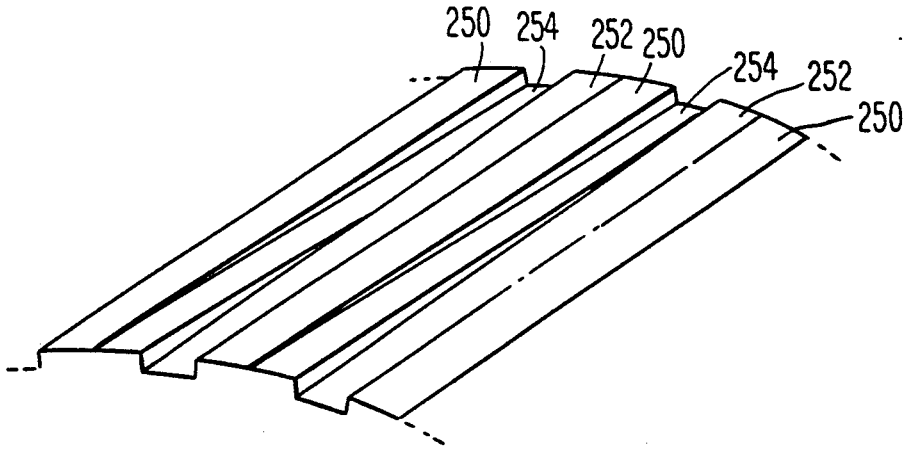
FIG. 4 is a fragmentary perspective view of an alternative polygonal mirror for use in the optical device of the present invention.

If it is desired to reduce the quantity of laser diodes which must be used to obtain a projected image having a specified level of resolution, a polygonal mirror having additional surfaces can be used so that two or more diode banks can be pulsed simultaneously to form different lines in the image as the mirror rotates. Similarly, an image significantly wider than the width of the diode bank can be achieved by employing a polygonal mirror in which some of the individual planar surfaces of the mirror are oriented at an angle with respect to the axis of rotation. For, example, such as illustrated in FIG. 4, a planar surface 250 aligned parallel the axis of rotation can be bordered by adjacent planar surfaces 252, 254 which are oriented at small (for example, about 5°–10°), opposed angles with respect to the axis of rotation. In this case, the polygonal mirror means can be said to include three classes of mirror faces, characterized by their respective orientation to the mirror axis of rotation. Other types of polygonal reflection means can be used, such as polygonal reflection means including two classes of faces, each disposed at a slight angle to the rotational axis, and opposite to each other (not shown). In general, such reflection means can include at least two classes of faces, each class characterized by its orientation to the axis of rotation.

Figure 5:
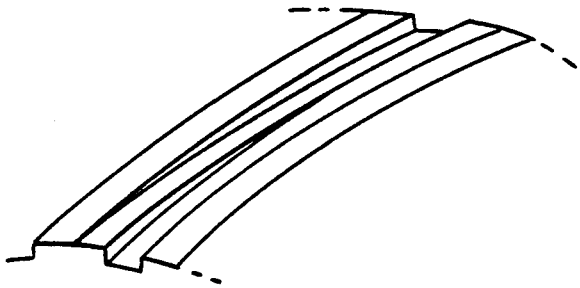
FIG. 5 is a fragmentary perspective view of another alternative polygonal mirror for use in the optical display device of the present invention.

Compensation for the distortion induced by the differing beam path lengths of the beams reflected for the parallel surfaces 250 and the angled surfaces 252, 254 can be electronic as described above for correction for the geometry of the projection screen. Alternatively, or in addition, the angled surfaces of the faces can be nonplanar, the geometry of the face being chosen to compensate for the induced distortion such as shown in FIG. 5. In this case, members of each of the mirror face classes are superimposable, and correspnding loci on the faces of each class are adopted to reflect an impinging light beam at the same angle, with corresponding loci being defined as lying in a common plane perpendicular to the axis of mirror rotation.

Further, depending on the duty cycle of the diode, a single diode can be used to illuminate several adjacent loci of the image, or pixels, in a single row by repeatedly selecting the diode as the mirror of FIG. 4 rotates through several faces orientated at different angles. An embodiment employing the mirror of FIG. 4 or FIG. 5 can also be used to provide greater perceived pixel intensity, or to maintain specific pixels in constant perceived illumination despite a finite duty cycle for each diode.

Figure 6:
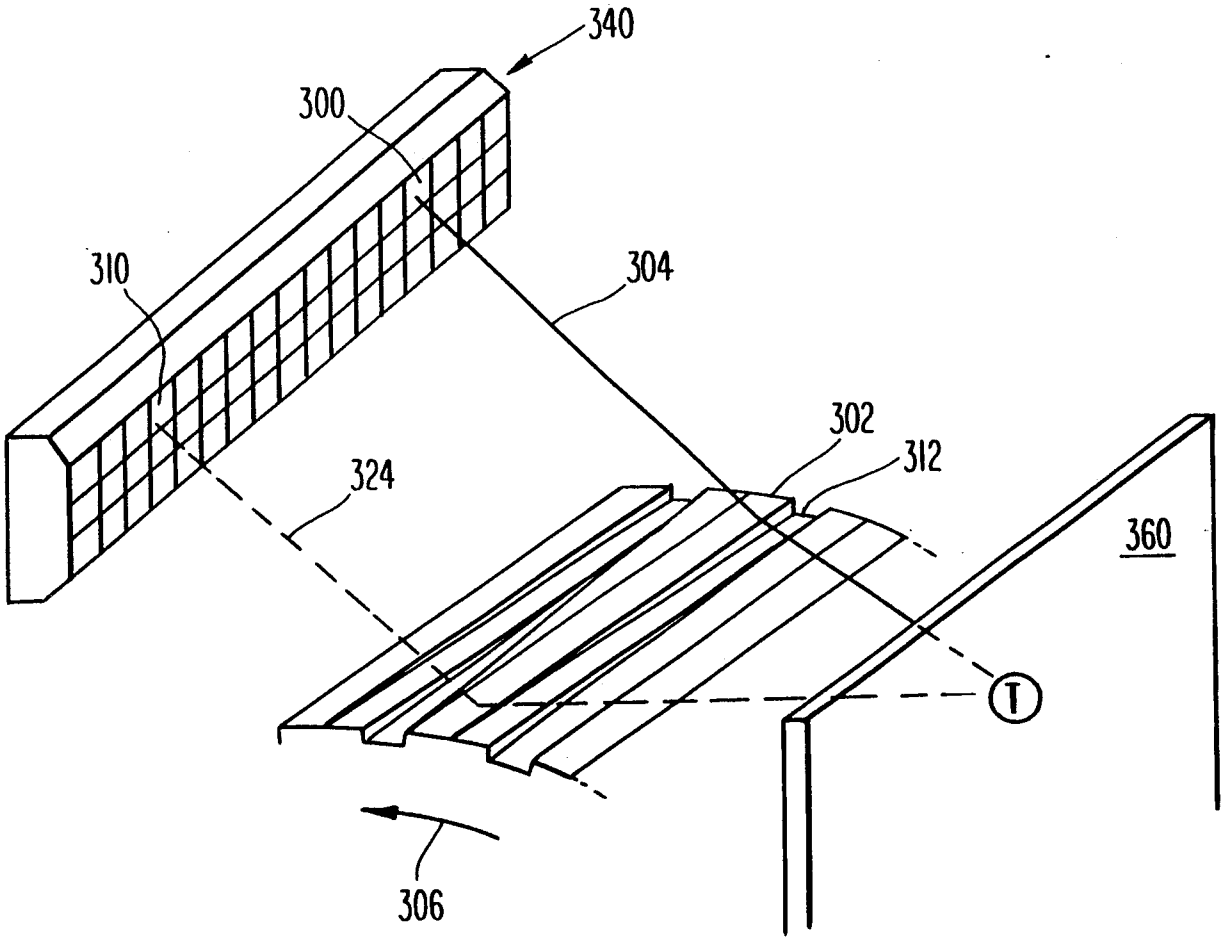
FIG. 6 is a fragmentary perspective view showing an embodiment of the invention employing the mirror of FIG. 4.

Two or more diodes can be directed to illuminate a single pixel by selecting them so that the rotating mirror of FIG. 4 presents a series of angled faces directing the beam from each diode in turn at the same locus on a target 360. This is shown schematically in FIG. 6, in which a first diode 300 of diode bank 340 is energized in synchronization with mirror face 302 to direct the beam 304 produced by the diode 300 to illuminate the target pixel "T". Subsequently, diode 310 is energized as the mirror turns in the direction of the arrow 306 and presents mirror face 312 to illuminate the same target pixel "T" shown as a dotted "beam" 324. Depending on the duty cycle of the diode, and speed of rotation of the mirror, the perception of differing colors can be created in this manner by using two or more diodes having differing spectral characteristics to illuminate a single target pixel.

Figure 3:
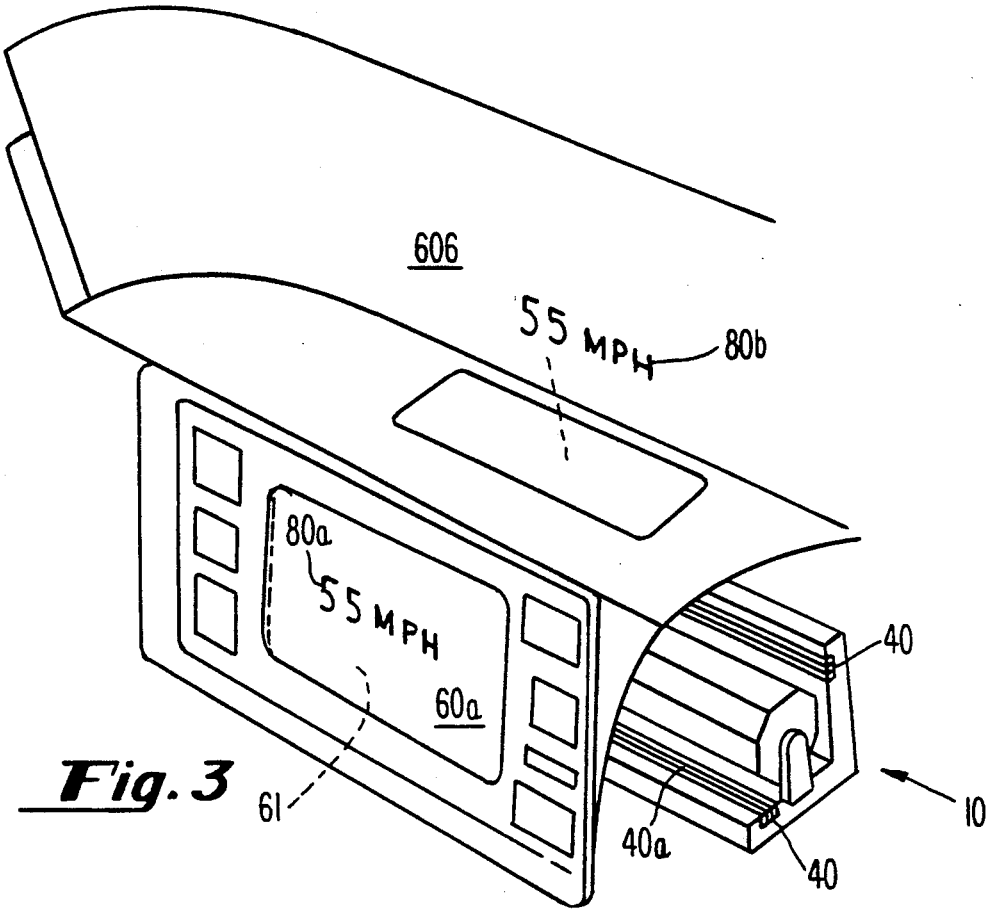
FIG. 3 is a fragmentary perspective view of a second embodiment of a pulsed laser optical display device of the present invention.

In another embodiment illustrated in FIG. 3 a pair of laser diodes banks 40 are used to illuminate a pair of protection screens **60*a*, 60*b*. In this case, the first projection screen 60*a* has a rear surface 61 which is illuminated by the first bank of laser diodes 40*a* and the corresponding image 80*a* is viewed through the first projection screen 60*a*. In addition, there is a second image 80*b*** which is displayed on the front surface of the second projection screen 60b, the second image 80b being directly observable on the surface. Either or both of the display surfaces can be coated or treated to enhance the visibility of the displayed image. For example, the surface of the first projection screen 60a can be treated or coated to render the first projection screen 60a translucent in part or in whole.

If desired, identical images can be displayed on both the first and second projection screens 60a, 60b. Alternatively, the two screens can be used to project completely different images. If desired, the second projection screen can be used to project an image which is derived from or a portion of the image displayed on the first projection screen. Images can be displayed continuously or intermittently on either the first or the second projection screen 60a, 60b.

For example, the first projection screen 60a can be used to display all or some of the information inventionally displayed on a vehicle control panel, such as an automobile or airplane control panel. For example, the vehicle speed can be displayed digitally and/or graphically, as by a bar graph having a length which varies in proportion to the vehicle speed. The second projection screen 60b could be used to display critical information intermittently. For example, the vehicle speed could be displayed on the second projection screen 60b only when the vehicle was exceeding a legal speed limit. Similarly, the second protection screen 60b could be used to display a graphic image reflecting a sensed emergency condition, such as loss of entire power, loss of oil pressure, or excessive engine temperature.

In another embodiment, the light output from the laser diode is selectively reflected by the rotating polygonal mirror means to impinge and form an image on the first terminus of a fiber optic cable. The fiber optic cable can convey the image to a remote location. For example, the cable can terminate proximate an eye, the image being perceived at the second cable terminus.

Various modifications can be made and the details of the various embodiments of the apparatus of the present invention, all within the spirit and scope of the invention is defined in the appended claims.

We claim:

1. A pulsed laser optical display device for displaying a projected image, the display device comprising:

a source of an image bit map;

means for generating a plurality of activation signals from the image bit map;

at least one light source bank including a plurality of solid state laser diodes oriented in a common direction, each diode adapted to produce a light beam;

a plurality of diode driver means, each diode driver means activating a respective laser diode in response to an activation signal;

at least one projection surface;

polygonal mirror reflection means for reflecting each beam to impinge on a projection surface;

drive means for rotating the polygonal mirror reflection means to sweep the light beams over the projection surface;

synchronization means for synchronizing the activation signal to each diode drive means with the rotation of the reflection means whereby a projected image is displayed on at least one projection surface that is perceived by an observer as a single, instantaneous image.

2. A display device according to claim 1 wherein the reflection means includes a plurality of planar mirror surfaces and the synchronization means includes a first means for sensing each angular position of the mirror reflection means at which a light beam from a laser diode bank can begin to impinge on a respective planar mirror surface as the reflection means rotates, the first angular position sensing means generating a first synchronization signal in response thereto.

3. A display device according to claim 2 wherein the synchronization means further include second means for sensing a plurality of intermediate angular positions of the reflection means as the reflection means rotates through an arc during which the light beams from a diode bank can impinge on a single reflecting surface, the second angular position sensing means generating a plurality of second synchronization signal pulses in response thereto.

4. A display device according to claim 3 further including means for detecting a second synchronization signal pulse and producing an activation signal to trigger predetermined diode drivers.

5. A display device according to claim 4 further including resetable row counter means for counting second synchronization signal pulses, the row counter means containing and outputing a row address.

6. A display device according to claim 5 further including a display memory means for storing an image, the display memory means being organized as n columns by m rows, and the activation signal generating means including means for selecting a predetermined row of the display memory means in response to the row counter means output, the display memory means including parallel output means for outputting the contents of the predetermined row to select diode drivers.

7. A display device according to claim 6 wherein the display memory means contains an initial n column by m row image map, and further including means for substituting a new image map in the display memory means by replacing each row of the initial image map with a respective row of the new image map as each row of the initial map is outputed to select diode drivers.

8. A display device according to claim 7 wherein the new image map is obtained from an image generating computer means.

9. A display device according to claim 7 further including interleaving CPU means.

10. A display device according to claim 3 further including means for conditioning the second synchronization signal pulses to adjust the output of the diode drivers to conform the displayed image to the geometry of the display surface.

11. An optical display device according to claim 1 including at least two sets of diodes producing light having different spectral characteristics.

12. An optical display device according to claim 11 including three sets of diodes producing light having different spectral characteristics, the display being adapted to display a full color image.

13. An optical display device according to claim 6 wherein the rotation of the drive means for the reflection means is synchronized with the operation cycle of the display memory means.

14. A display device according to claim 1 wherein the polygonal reflection means includes at least two classes of mirror faces, corresponding loci on the faces of each such class being adapted to reflect an impinging light beam at the same angle, the corresponding loci being defined as lying in a common plane perpendicular to the axis of reflection means rotation, so that a single locus of the image can be illuminated sequentially by two or more diodes, activated sequentially as the polygonal mirror reflection means is rotated.

15. A display device according to claim 14 wherein the mirror faces are planar.

16. A display device according to claim 14, the device being adapted so that a single image locus can be sequentially illuminated by a series of at least two diodes having differing spectral characteristics.

17. A display device according to claim 14, the device being adapted so that a single diode can illuminate different image loci as the reflection means rotates.

18. A pulsed laser optical display device for displaying a projected image, the display device comprising:

a source of an image bit map;

means for generating a plurality of activation signals from the image bit map;

at least one light source bank including at least one first bank of diodes containing a plurality of solid state diodes oriented in a common direction, and at least one second bank of diodes containing a plurality of solid state diodes oriented in a common direction, each diode adapted to produce a light beam;

at least one first projection surface and at least one second projection surface, the light beams generated by the at least one first diode bank being directed by the reflection means to the first projection surface, and the light beams generated by the at least one second bank of diodes being directed by the reflection means of the second projection surface;

a plurality of diode driver means, each diode driver means activating a respective laser diode in response to an activation signal;

polygonal mirror reflection means for reflecting each beam to impinge on a projection surface;

drive means for rotating the polygonal mirror reflection means to sweep the light beams over the projection surface; and synchronization means for synchronizing the activation signal to each diode driver means with the rotation of the reflection means whereby a projected image is displayed on at least one projection surface that is perceived by an observer as a single, instantaneous image.

19. A display device according to claim 18 including a first projection screen including a first projection surface, the first light beam impinging on the first projection surface to form a first image, the first image being viewed through the first projection surface.

20. A display device according to claim 19 wherein at least predetermined portions of the first projection surface are transluscent.

21. A display device according to claim 18 including a second projection screen means, the second light beam impinging on the second projection surface to form a second image, the second image being directly viewable by an observer.

22. A display device according to claim 21 further including display selection means for directing at least a portion of the image bit map to generate an image on either the first or second projection screen or both.

23. A display device according to claim 22 further including sensing means for sensing an external condition, the display selection means being adapted to respond to the sensing means to alter the image displayed in response to the sensing means.

24. A display device according to claim 22 in which the second projection screen is illuminated in response to the occurance of an external condition by the sensing means.

25. A display device according to claim 1 wherein the diodes are infrared laser diodes and additionally comprising means for shifting the frequency of the output beams of the laser diodes into the visible range.

* * * * *